US009883785B2

(12) United States Patent
Sampaio

(10) Patent No.: US 9,883,785 B2
(45) Date of Patent: Feb. 6, 2018

(54) DISPENSING PAD CLEANER

(71) Applicant: Casabella Holdings, L.L.C., Congers, NY (US)

(72) Inventor: Andre Sampaio, Valley Cottage, NY (US)

(73) Assignee: Casabella Holdings L.L.C., Congers, NY (US)

( * ) Notice: Subject to any disclaimer, the term of this patent is extended or adjusted under 35 U.S.C. 154(b) by 0 days.

(21) Appl. No.: 14/990,966

(22) Filed: Jan. 8, 2016

(65) Prior Publication Data

US 2017/0172380 A1 Jun. 22, 2017

Related U.S. Application Data

(63) Continuation-in-part of application No. 14/977,015, filed on Dec. 21, 2015.

(51) Int. Cl.

| | |
|---|---|
| ***B43K 5/02*** | (2006.01) |
| ***A47L 25/00*** | (2006.01) |
| ***A47L 13/16*** | (2006.01) |
| ***A47L 13/17*** | (2006.01) |

(52) U.S. Cl.

CPC ..... *A47L 25/00* (2013.01); *A47L 13/16* (2013.01); *A47L 13/17* (2013.01)

(58) Field of Classification Search

CPC ..... A46B 11/06; A46B 11/001; A47L 13/26; A47L 25/08; A47L 13/12; A47L 25/00; A47L 13/16; A47L 13/17; B05C 17/0056

USPC ..... 401/13, 279, 137, 289, 188 R

See application file for complete search history.

(56) References Cited

U.S. PATENT DOCUMENTS

| | | | | |
|---|---|---|---|---|
| 854,151 | A | 5/1907 | Deasy | |
| 2,103,493 | A * | 12/1937 | Robertson | A46B 11/0058 222/192 |
| 231,210 | A | 2/1943 | Mead | |
| 2,772,430 | A * | 12/1956 | Moritt | A47L 17/00 15/111 |
| D269,565 | S | 7/1983 | Goldstaub | |
| 5,114,255 | A * | 5/1992 | Villarreal | A47L 13/26 15/230.16 |
| D329,752 | S | 9/1992 | Murphy | |
| 5,213,430 | A | 5/1993 | Pandola | |
| D356,446 | S | 3/1995 | Hoagland | |
| D357,124 | S | 4/1995 | Greenhouse | |
| 5,452,961 | A * | 9/1995 | Lu | A46B 11/066 401/281 |

(Continued)

FOREIGN PATENT DOCUMENTS

DE 10250992 A1 5/2004

*Primary Examiner* — Jennifer C Chiang

(74) *Attorney, Agent, or Firm* — Curtis, Mallet-Prevost, Colt & Mosle, LLP

(57) ABSTRACT

A dispensing pad cleaner having a novel integrated dispensing system for delivering cleaning solutions and similar liquids to a surface to be cleaned. A removable cleaning pad coupled to a flexible pad substrate is also provided. The dispensing system has a reservoir for liquid retention that is coupled to the dispensing pad cleaner. An integral pump dispenses the liquid from the reservoir and through a nozzle to a surface to be cleaned. The pump is actuated from a lever that is depressed by a user, at times repeatedly, to facilitate pumping of the liquid onto a surface to be cleaned by scrubbing action of the dispensing pad cleaner.

18 Claims, 14 Drawing Sheets

(56) References Cited

U.S. PATENT DOCUMENTS 5,522,110 A * 6/1996 Borofsky ..... A47L 13/12 15/115
D376,262 S 12/1996 Ancona
D431,367 S 10/2000 Burkhardt
D437,691 S 2/2001 Weiss
6,202,250 B1 * 3/2001 Kenmochi ..... A47L 13/20 15/209.1
6,250,833 B1 * 6/2001 Perry ..... A46B 11/0013 401/206
6,305,046 B1 * 10/2001 Kingry ..... A47L 13/46 15/228
6,746,166 B1 * 6/2004 Jeon ..... A46B 11/0041 401/13
D493,287 S 7/2004 Hay
7,682,097 B2 * 3/2010 Knopow ..... A47L 1/15 401/136
D613,070 S 4/2010 Huang
8,025,453 B2 * 9/2011 Chan ..... B60S 3/047 401/188 R
8,109,685 B1 * 2/2012 Vito ..... A46B 5/0095 401/188 R
8,152,400 B2 * 4/2012 LaFlamme ..... A47L 13/22 401/187
D672,150 S 12/2012 Chitayat
8,561,245 B2 * 10/2013 Weis ..... A47L 13/12 15/116.2
8,684,619 B2 * 4/2014 Uchiyama ..... A46B 5/0058 15/143.1
9,044,852 B2 * 6/2015 Shafer ..... A46B 11/0017
2002/0050016 A1 * 5/2002 Willman ..... A47L 13/16 15/104.002
2003/0108378 A1 * 6/2003 Sickler ..... A46B 11/06 401/289
2006/0233592 A1 * 10/2006 Knopow ..... A47L 1/15 401/139
2007/0256266 A1 * 11/2007 Michelson ..... A47L 13/20 15/228
2008/0098546 A1 * 5/2008 Warmka ..... A47L 17/08 15/104.94
2008/0205965 A1 * 8/2008 LaFlamme ..... A45D 34/04 401/6
2009/0236359 A1 * 9/2009 Linzell ..... A61H 7/004 221/45
2012/0096662 A1 * 4/2012 Uchiyama ..... A46B 5/0058 15/160
2012/0301208 A1 11/2012 Hughes
2016/0157596 A1 * 6/2016 Fifield ..... A46B 11/0055 15/104.94

* cited by examiner

DISPENSING PAD CLEANER

CROSS REFERENCE TO RELATED PATENT APPLICATIONS

This application is a Continuation-in-Part of U.S. patent application Ser. No. 14/977,015 filed Dec. 21, 2015 entitled "Dispensing Brush" by Andre Sampaio, the entire disclosure of which is incorporated herein by reference.

BACKGROUND OF THE INVENTION

1. Field of the Invention

This invention relates generally to cleaning devices, and more specifically to a dispensing pad cleaner that delivers a cleaning solution from the device without the need for a separate cleaning solution dispenser.

2. Description of Related Art

Scrubbers and other cleaning devices have been used throughout the years as tools to facilitate the cleaning of objects where undesirable material is stubbornly attached to the object, requiring mechanical abrasion of the undesirable material for proper cleaning. These devices often have an abrasive surface to provide cleaning action when the device is moved over the object to be cleaned, often times repeatedly. Devices to clean objects have taken on a variety of forms over the years, and have included many different abrasive surfaces and forms. A scrubber is a cleaning device that has some form of scrubbing surface or surfaces to abrade and remove undesirable material. A pad cleaner is a form of scrubber where the scrubbing surface of the cleaning device is formed as a pad. The scrubbing surface and material of the cleaning device may vary in composition, abrasiveness, form, thickness, or other factors to better suit the cleaning task at hand. For example, while a scrub brush may be suitable for cleaning grout lines in a shower, it would be cumbersome to use to clean a glass shower door. A scrubber with a suitably abrasive scrub pad would, however, make the cleaning of the glass shower door faster and more thorough.

While there are times when a cleaning device such as a scrubber or pad cleaner can be effectively used without a solvent or cleaning solution, often a cleaning solution, solvent or other such liquid will make the cleaning process easier and more effective. The cleaning solution is often applied to the object to be cleaned either before scrubbing with the cleaning device or during the scrubbing operation. The way in which the cleaning solution is applied in conjunction with the cleaning operation is often a matter of personal preference, and a variety of containers to retain the cleaning solution can be found in most stores. There are times when the container that retains the cleaning solution is not well suited for dispensing the proper amount of cleaning solution, and the resulting cleaning operation is either less than effective or the cleaning solution is wasted or over used. What is therefore needed is a pad cleaner with an integrated cleaning solution dispenser.

It is thus an object of the present invention to provide such a dispensing pad cleaner.

These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided a dispensing pad cleaner comprising a handle attached to a pad substrate; the pad substrate comprising a flexible material; a reservoir for liquid retention; a pump capable of receiving liquid from the reservoir; a dispensing nozzle to deliver liquid from the pump; a lever mechanically coupled to the pump such that movement of the lever causes actuation of the pump and subsequent dispensing of the liquid.

The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
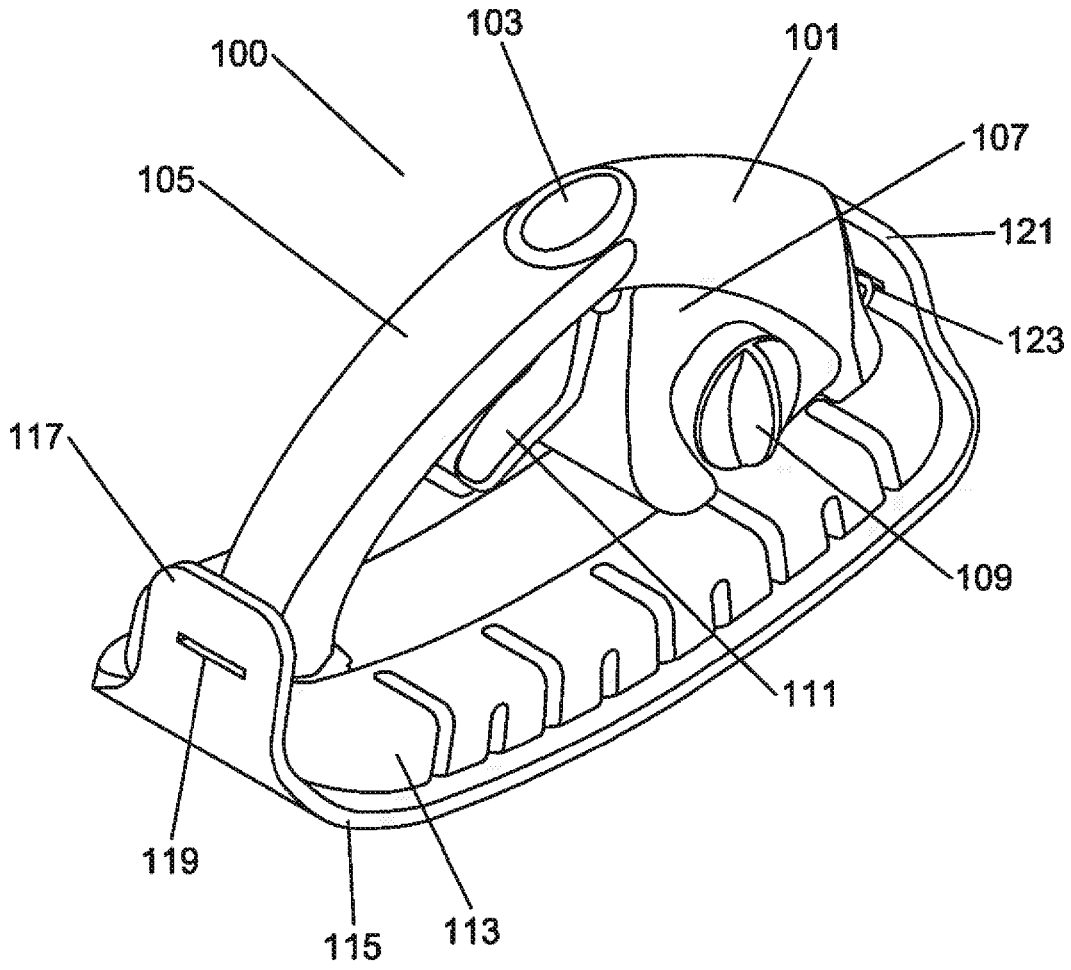
FIG. 1 is a perspective view of a dispensing pad cleaner of the present invention.

The attached figures depict various views of the dispensing pad cleaner in sufficient detail to allow one skilled in the art to make and use the present invention. These figures are exemplary, and depict a preferred embodiment; however, it will be understood that there is no intent to limit the invention to the embodiment depicted herein. On the contrary, the intent is to cover all alternatives, modifications, and equivalents as may be included within the spirit and scope of the invention as defined by this specification, claims and drawings.

DESCRIPTION OF THE PREFERRED EMBODIMENTS

A Dispensing pad cleaner is described and depicted by way of this specification and the attached drawings.

For a general understanding of the present invention, reference is made to the drawings. In the drawings, like reference numerals have been used throughout to designate identical elements.

The Dispensing pad cleaner of the present invention, as described and depicted herein, provides, among other things, a novel liquid reservoir and dispensing mechanism that delivers a liquid such as a cleaning solution toward the working surface of the cleaning pad, thus improving the efficiency of the cleaning process and providing improved cleaning.

FIG. 1 is a perspective view of a dispensing pad cleaner of the present invention. The dispensing pad cleaner may be made from any suitable material, for example, a plastic. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, wood, or other materials that may be suitably formed may also be used. The various components of the dispensing pad cleaner may be made by injection molding, blow molding, machining, extruding, forming, or the like. The various components are then assembled in accordance with the instructions and figures provided herein.

Figure 2:
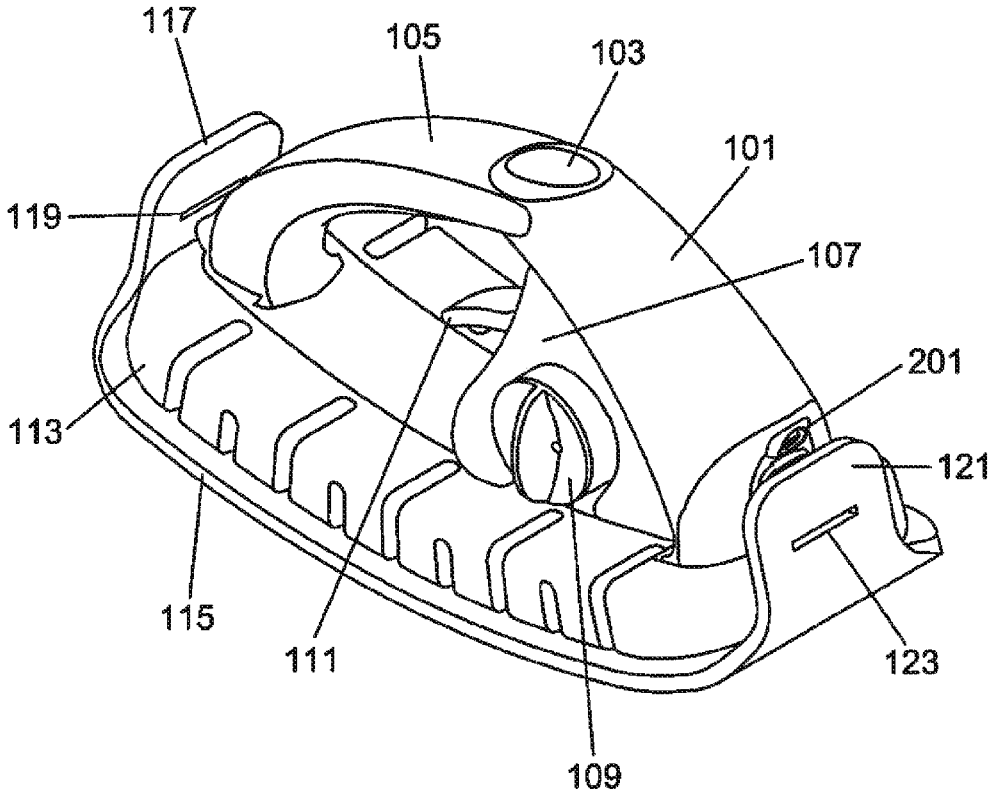
FIG. 2 is a rotated perspective view of the dispensing pad cleaner.
Figure 9:
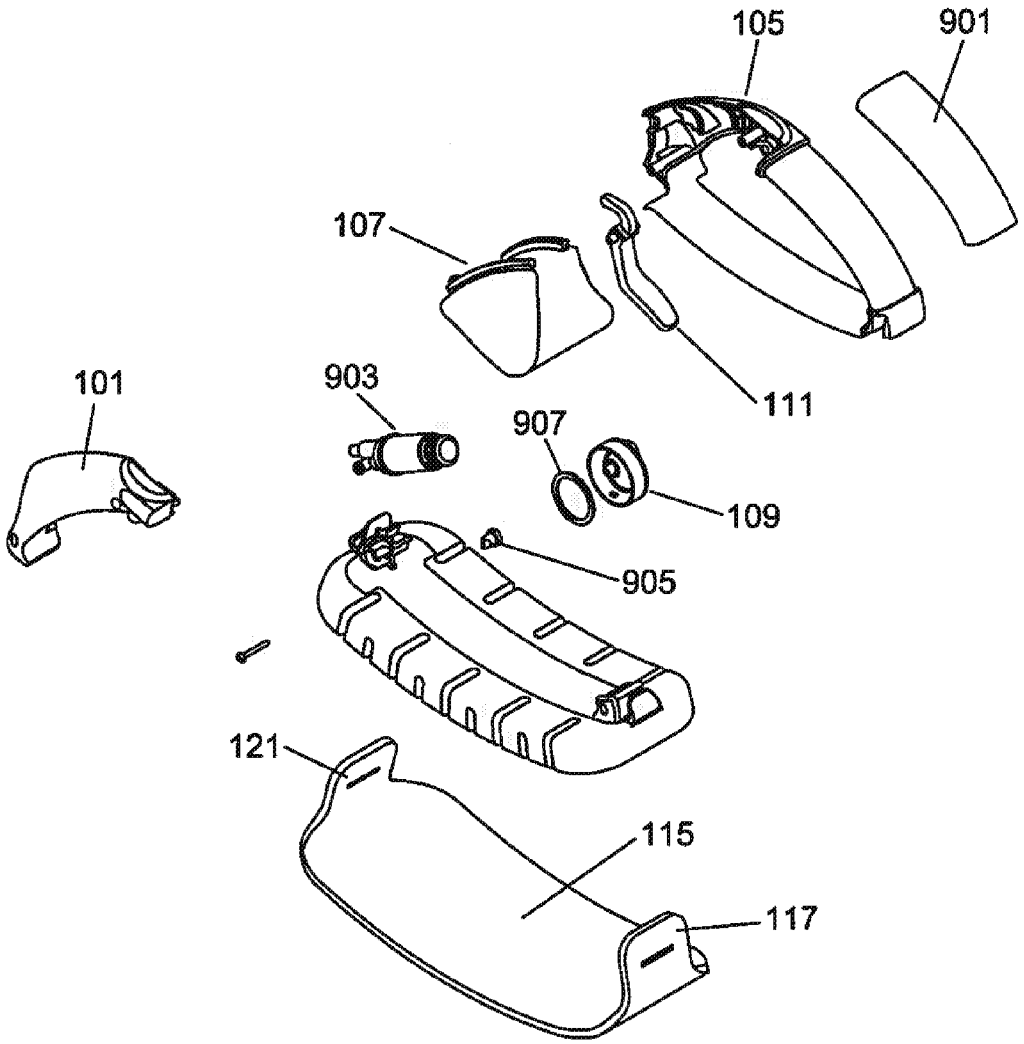
FIG. 9 is an exploded view of the dispensing pad cleaner.

As can be seen in FIG. 1, a dispensing pad cleaner 100 is shown comprising a handle and related handle assembly 105 attached to a pad substrate 113. The pad substrate 113 may be flexible, and may be made from a material that has cushioning and flexibility, such as various polymers. An example of such a material is EVA (Ethylene-vinyl acetate). The pad substrate 113 may also be curved in some embodiments of the present invention. The pad substrate 113 retains a cleaning pad 115. This pad 115 comprises an abrasive cleaning material such as a woven synthetic or plastic, for example, woven polyethylene, polypropylene, nylon, or the like. In some embodiments of the present invention, the pad 115 comprises a woven metal such as stainless steel, brass, or the like. The woven material, regardless of composition, may vary in abrasiveness and other properties depending on the cleaning application. The pad 115 may also be non-woven, and may comprise a cleaning fabric or other suitable cleaning material. In some embodiments of the present invention, the pad 115 may contain a cleaning material such as a detergent, bleach, cleaning particles, or the like. The pad 115 is formed such that it may be retained by the dispensing pad cleaner, specifically by fixtures designed to retain the pad 115 to the pad substrate 113. As seen in FIG. 1, an example of such retention means are provided. A first pad retention tab 117 can be seen as part of the pad 115 and a second pad retention tab 121 can be seen as well. In each retention tab a retention slot can also be seen. A first pad retention slot 119 can be seen transverse to the first pad retention tab 117 and a second pad retention slot 123 can be seen transverse to the second pad retention tab 121. These slots each receive a pad hook, as further seen in FIG. 17. The slots may be of various geometries, such as rectangular, circular, oval, or the like. A reservoir 107 for liquid retention can also be seen fixed below the handle and may, in some embodiments of the present invention, be shaped to conform to the underside of the handle. A pump (as shown in FIG. 9 as 903) is also part of the dispensing pad cleaner 100 and is capable of receiving liquid from the reservoir 107 when so filled. A dispensing nozzle 201, as can be seen in FIG. 2, is arranged to deliver liquid contained in the reservoir through the action of the pump 903. A lever and related pump actuator lever assembly 111 is mechanically coupled to the pump 903 (as seen in FIG. 9) such that movement of the lever causes actuation of the pump and subsequent dispensing of the liquid contained in the reservoir 107. The reservoir 107 can be seen clearly attached to the dispensing pad cleaner 100 such that it is integral with the dispensing pad cleaner 100 during a cleaning operation.

The handle assembly 105 comprises a front support beam 101 that is curved to conform to a user's hand and provides adequate width and structural integrity to support the reservoir 107. In some embodiments of the present invention, the handle assembly 105 is made in two or more parts to accommodate placement of a pump and related structural elements within and attached thereto. Such structural details are shown by way of example, and not limitation, in FIG. 9. The front support beam transitions into the main handle where a thumb rest 103 can be seen. The thumb rest may simply be a flattened area of the handle or may, in some embodiments of the present invention, be depressed or concave to more comfortably support the thumb or appendage of a user. As seen and taught by way of example in FIG. 1, the reservoir 107 is generally wedge shaped to best accommodate it's location under and attached to the front support beam 101 and related handle assembly 105. The reservoir 107 may be made from a clear, opaque, or translucent plastic such that the contents of the reservoir, and their depletion level, can be clearly seen by the user. The shape of the reservoir 107 may also vary along a vertical dimension such that there is additional ability to accommodate cleaning solution toward the bottom area of the reservoir 107. A reservoir cap 109 can also be seen in FIG. 1 attached to the side (vertical wall) of the reservoir 107. The placement of the reservoir cap 109 may vary, with some embodiments of the present invention placing the reservoir cap on the top or bottom horizontal surfaces of the reservoir 107. The reservoir cap 109 may also be placed at an angle to any side by appropriate modification of the shape of the reservoir through tooling and related computer aided design (CAD). Further, the reservoir wall where the reservoir cap 109 is placed may protrude outward past the reservoir cap 109 in order to accommodate more cleaning solution and further to provide a more positive area for the reservoir cap to be situated.

Under the handle assembly 105 can also be seen a pump actuator lever assembly 111 that can be gripped and moved by a user to in turn move and actuate a pump that moves the cleaning solution or similar liquid from the reservoir 107 and out a nozzle (such details to be later described with the assistance of subsequent figures). The pump actuator lever assembly 111 may, in some embodiments of the present invention, be bent or angled such that a portion of the pump actuator lever assembly 111 is generally parallel to the handle (although variations on such parallel precision may be a matter of design choice, and a curved or otherwise non-parallel pump actuator lever assembly portion may be employed). The pump actuator lever assembly 111 also contains further structural components that will be further depicted and described by way of FIG. 12.

As can also be seen in FIG. 1, a pad 115 can be seen removably attached to the pad substrate 113. The pad 115 can be replaced when worn, or when a different style cleaning pad is desired due to the nature of the cleaning task. The pad substrate 113 may be curved in some embodiments to provide a better overall cleaning form. The pad substrate 113 may also comprise slots completely through the pad substrate, and may also comprise slots that are only partially through the thickness of the pad substrate 113. These various slots may be fashioned singularly, or may alternate such that the fully through slots and the partially through slots are adjacent each other in an alternating arrangement. In some embodiments of the present invention, the pad substrate 113 may be flexible or semi-flexible due to variables such as choice of material, thickness of material, number of slots, and the like. As will be further seen in subsequent figures, the pad substrate 113 is attached to the handle assembly 105 and a pad substrate strut and pad substrate retention fixture may further be employed to facilitate structural attachment of the handle to the substrate and related bristles. Such further details can be seen by way of example in FIG. 13.

FIG. 2 is a rotated perspective view of the dispensing pad cleaner that clearly shows the dispensing nozzle 201. The dispensing nozzle 201 is directed toward the leading edge or cleaning surface of the dispensing pad cleaner 100 in such a way that cleaning solution or similar liquid is deposited on the surface to be cleaned. The user may chose to dispense the cleaning solution or liquid while scrubbing with the dispensing pad cleaner 100, or may lift the dispensing pad cleaner 100 away from the cleaning surface and direct the dispensing nozzle 201 at an area where the cleaning solution is to be applied. In this manner, the user can carry the dispensing pad cleaner 100 without the need to carry and pick up a cleaning device and cleaning solution dispensing bottle separately. Such convenience not only saves time, but through the precise application of cleaning solution also saves unnecessary consumption of cleaning solution during a cleaning task. In some embodiments of the present invention, the dispensing nozzle 201 is adjustable to change the spray pattern and/or delivery volume. The adjustment may be made by rotation of the nozzle, insertion of a screwdriver blade and subsequent rotation of the nozzle, or the like.

The reservoir cap 109 can also be seen in FIG. 2 as having a grip for ease of rotation and removal. The grip may be a longitudinal span, a knob, a point, knurls, other geometries, or simply the reservoir cap itself. Also seen is a vent hole that is coupled with a taper valve as seen in FIG. 9.

Figure 3:
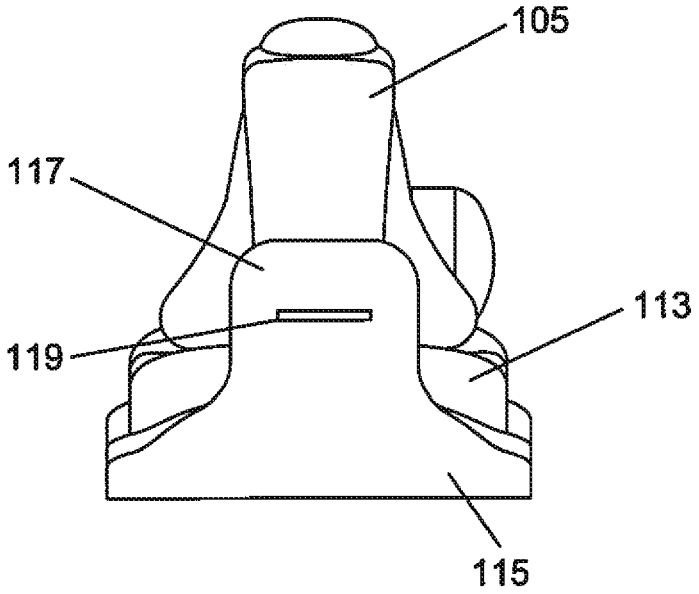
FIG. 3 is a rear plan view of the dispensing pad cleaner.

FIG. 3 is a rear plan view of the dispensing pad cleaner where another perspective of the handle assembly 105 can be seen.

Figure 4:
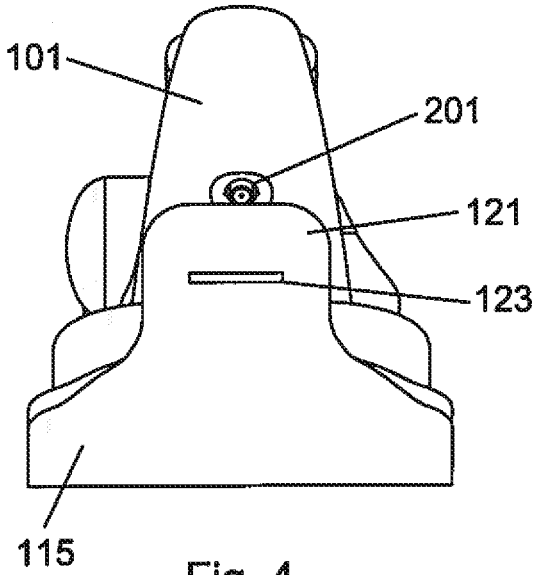
FIG. 4 is a front plan view of the dispensing pad cleaner.

FIG. 4 is a front plan view of the dispensing pad cleaner showing clearly the placement of the dispensing nozzle 201. As previously stated, the nozzle may be adjustable and further may be directional.

Figure 5:
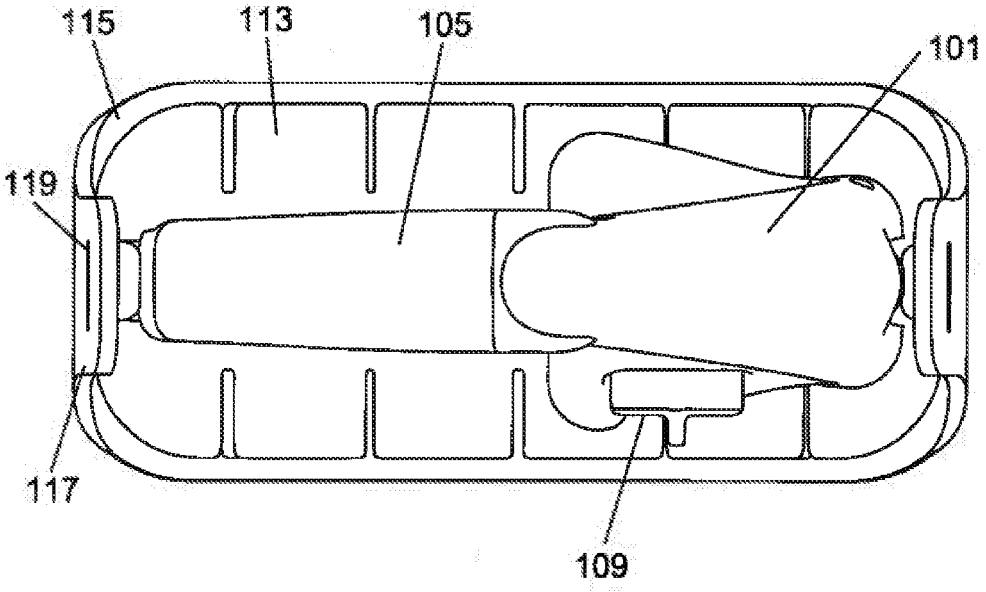
FIG. 5 is a top plan view of the dispensing pad cleaner.

FIG. 5 is a top plan view of the dispensing pad cleaner. The flared bottom of the reservoir and the placement of the reservoir under the handle can be seen. The front support beam 101 of the handle assembly 105 is seen to be progressively larger than the handle itself in this exemplary embodiment. This larger size provides not only structural rigidity, but also accommodates internal placement of the pump, as shown in FIG. 9.

Figure 6:
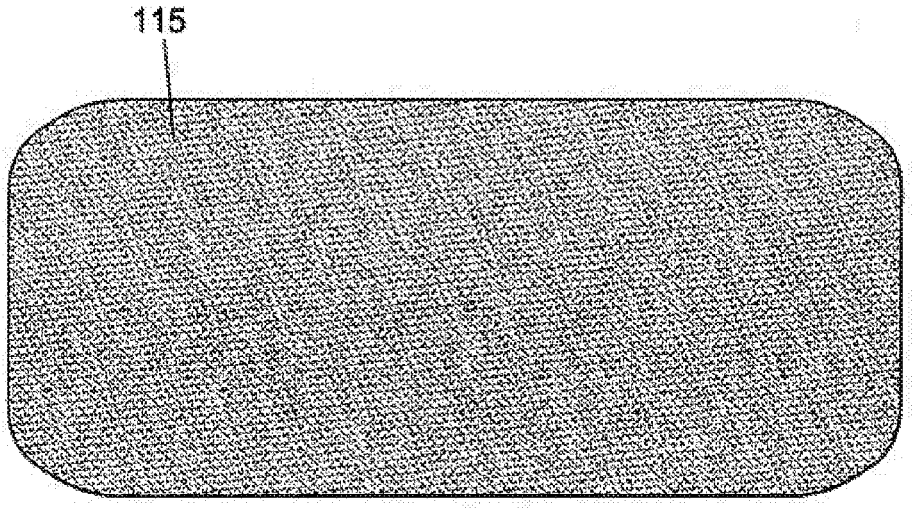
FIG. 6 is a bottom plan view of the dispensing pad cleaner.

FIG. 6 is a bottom plan view of the dispensing pad cleaner. The texture of the woven pad material of the pad 115 can be seen.

Figure 7:
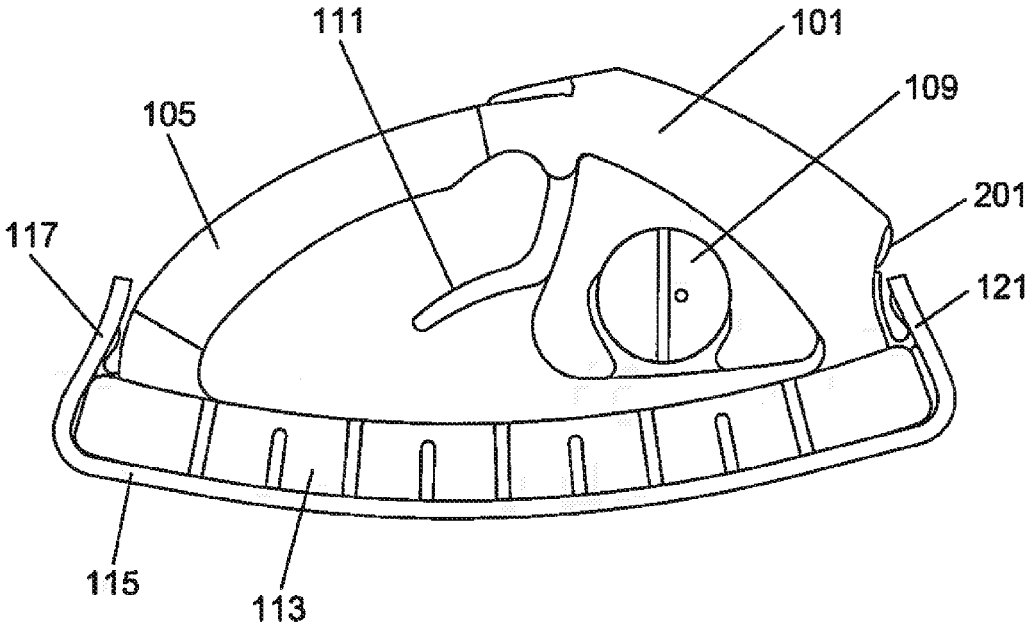
FIG. 7 is a side plan view of the dispensing pad cleaner.

FIG. 7 is a side plan view of the dispensing pad cleaner that further shows the pump actuator lever and the angle thereof. Placement of the reservoir 107 in relation to the handle assembly 105 can also be seen as well as the exemplary slots or cuts in the pad substrate 113.

Figure 8:
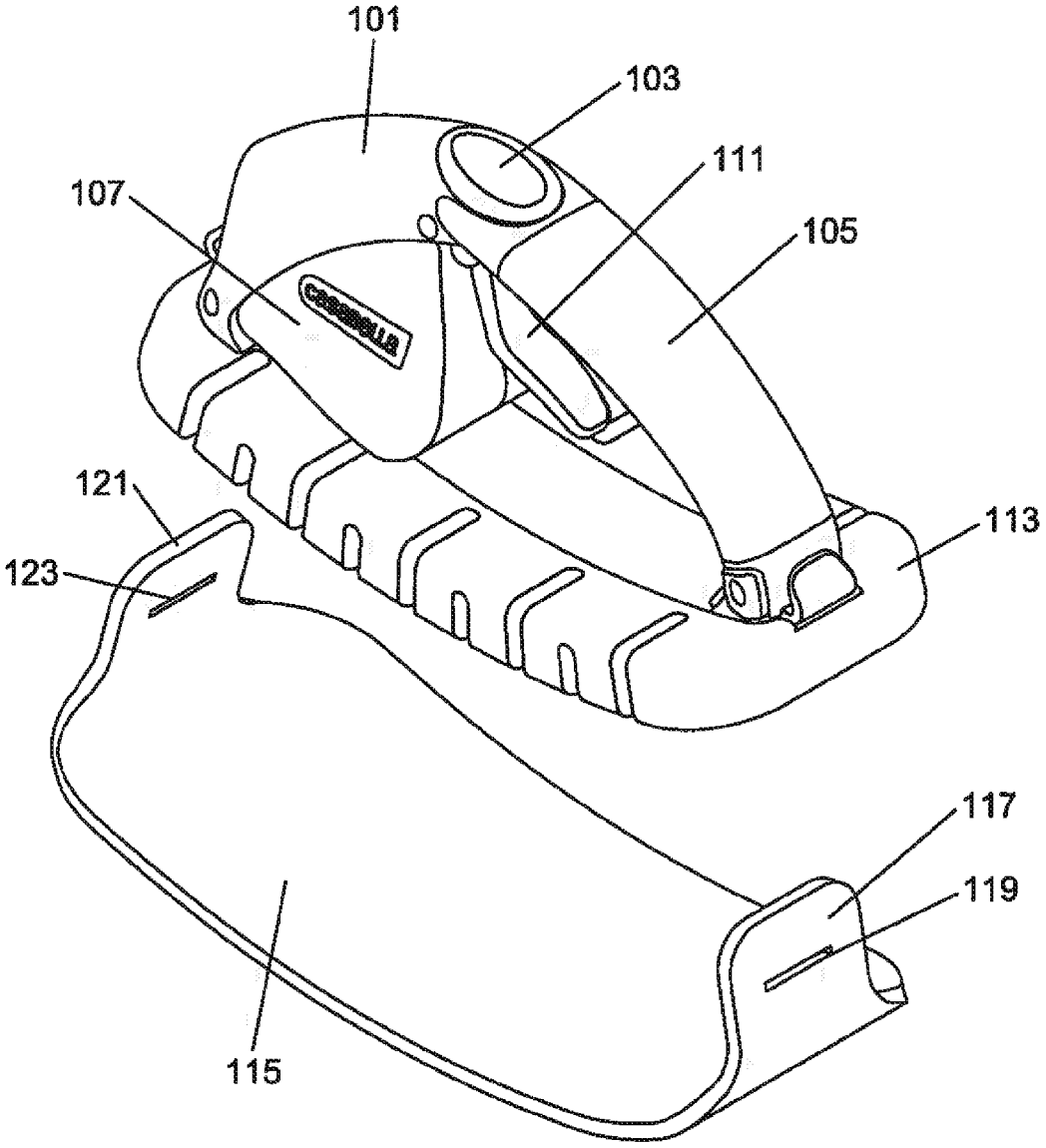
FIG. 8 is a perspective view of the dispensing pad cleaner showing the cleaning pad removed.

FIG. 8 is a perspective view of the dispensing pad cleaner showing the cleaning pad removed. The way in which the cleaning pad 115 is attached to the dispensing pad cleaner can be clearly seen.

FIG. 9 is an exploded view of the dispensing pad cleaner. A handle overlay 901 can be seen as an optional item to provide comfort to the user, as the handle overlay is made from a soft durometer material, and may cover the entire handle or a portion thereof. A pump 903 can also be seen that provides fluid communication and fluid delivery between the reservoir 107 and the dispensing nozzle 201 that is depicted in FIG. 2. The reservoir 107 has an opening or hole that is in turn connected to the pump 903 for the entry and subsequent expulsion of liquid previously contained in the reservoir 107. The pump 903 may be any form of mechanical pump including a piston actuated or diaphragm style pump. In FIG. 9, the pump 903 is mechanically coupled to the pump actuator lever assembly 111 by way of a cam feature that provides translational force from the lever piece through a curved cam structure and into a linear drive of the pump 903 where the linear drive includes a stem or similar surface to receive the force from the cam and transfer it to a piston or fluid moving arrangement within the pump to force liquid from the reservoir 107 and out the dispensing nozzle 201 with force sufficient to broadcast or spray the liquid onto a surface to be cleaned.

Figure 10:
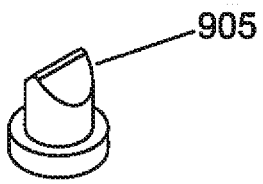
FIG. 10 depicts a taper valve of the reservoir cap.

A gasket seal 907 can also be seen, and provides a liquid tight seal when the reservoir cap 109 is properly attached to the reservoir 107. The gasket seal 907 may be a flat annular seal that is retained by a lip or recess on the reservoir cap itself, or may be an O-ring or the like. The gasket seal may be made from any soft durometer material suitable for liquid tight sealing, such as rubber, silicone rubber, various expanded or closed cell synthetic materials, cork, or the like. Also, a taper valve 905 can be seen that provides for replacement air into the reservoir 107 as liquid is being dispensed. FIG. 10 shows a close up view of this taper valve. The taper valve 905 brings two edges of material into close contact such that in one direction the edges are tight and in the other direction the edges are loose to allow for the passage of air while excluding the entry of liquid in an opposite direction. The taper valve 905 uses edges that are tapered or angled toward each other to accomplish this objective, and allows the reservoir cap 109 to be placed on a vertical wall of the reservoir 107 without leaking.

In some embodiments of the present invention the pump 903 is an electrically driven pump that is actuated through a lever, button or switch that contains electrical contacts.

FIG. 10 depicts a taper valve 905 of the reservoir cap. As previously described, the taper valve 905 is attached to a protrusion and opening on the reservoir cap 109 on the inward facing portion of the reservoir cap 109. The angled or tapered surfaces of the soft durometer material of the taper valve provide a liquid seal in one direction while allowing make up air to enter the reservoir 107 in the other direction.

Figure 11:
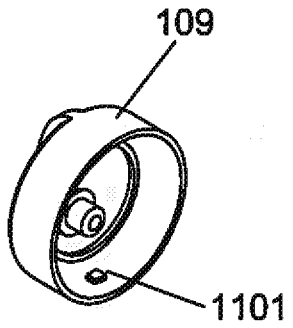
FIG. 11 depicts an engagement feature of the reservoir cap.

FIG. 11 depicts an engagement feature 1101 of the reservoir cap. This engagement feature may be a protrusion or recess that couples and locks with an opposing feature on the reservoir 107 along the surface where the reservoir cap 109 attaches to the reservoir 107.

Figure 12:
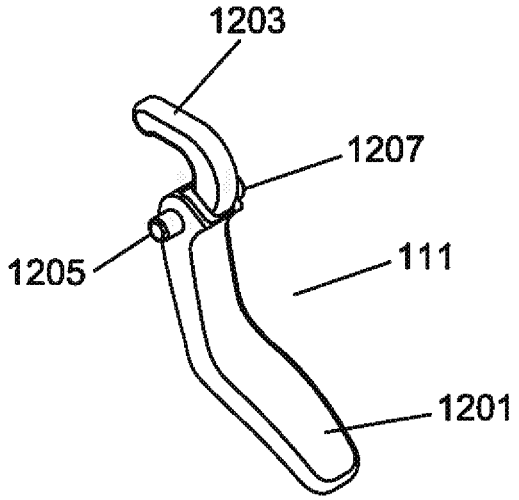
FIG. 12 depicts a pump actuator lever assembly of the dispensing pad cleaner.

FIG. 12 depicts a pump actuator lever assembly 111 of the dispensing pad cleaner. A lever 1201 can be seen with a flattened or otherwise ergonomic surface to allow interaction by a user. Such interaction includes repeated movement of the lever 1201 to drive the pump 903 (see FIG. 9) and expel liquid from the dispensing nozzle 201 (see FIG. 2). A pump engagement cam 1203 can also be seen mechanically coupled or formed with the lever 1201. The pump engagement cam 1203 provides translational force from the lever 201 through a cam 1203 and into a linear drive of the pump 903 where the linear drive includes a stem or similar surface to receive the force from the cam 1203 and transfer it to a piston or fluid moving arrangement within the pump to force liquid from the reservoir 107 and out the dispensing nozzle 201 with force sufficient to broadcast or spray the liquid onto a surface to be cleaned. The pump engagement cam 1203 may be curved or angled to facilitate proper interaction between the lever 1201 and the pump 903 as seen in FIG. 9. To allow the pump actuator lever assembly 111 to pivot or hinge repeatedly in order to drive the pump, a first hinge pin 1205 and a second hinge pin 1207 can be seen protruding from the pump actuator lever assembly 111 at a suitable location such that recesses or similar features in the dispensing pad cleaner handle assembly 105 are able to receive and interact with the hinge pins such that movement occurs that is sufficient and adequate to drive the pump.

Figure 13:
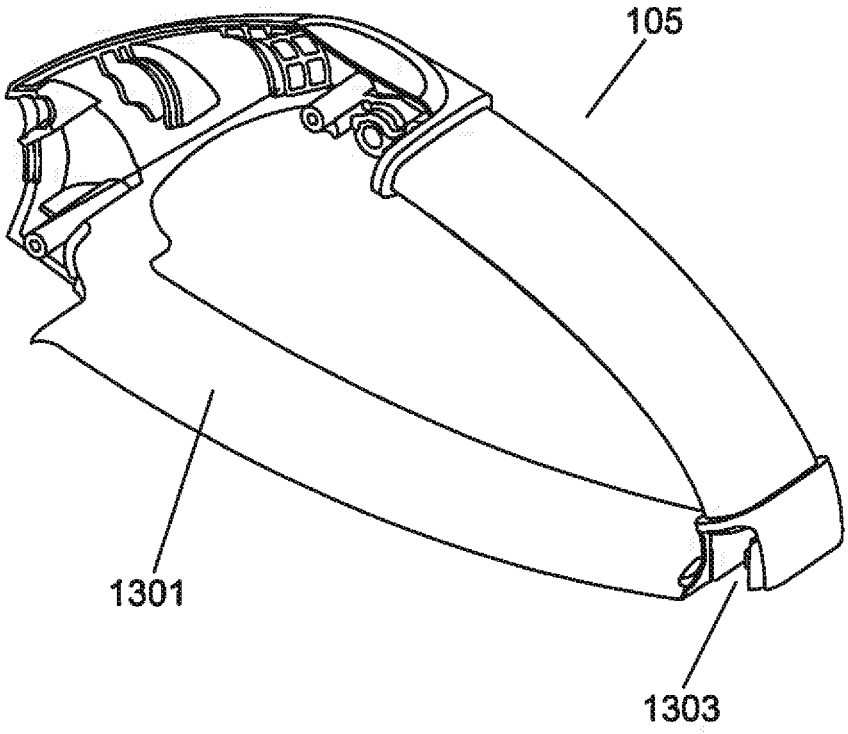
FIG. 13 depicts a handle assembly of the dispensing pad cleaner.

FIG. 13 depicts a handle assembly 105 of the dispensing pad cleaner. The various features within the handle assembly to accommodate the pump 903 (not shown in FIG. 13) can be seen. In addition, a pad substrate strut 1301 can be seen that has a generally flat appearance to accommodate attachment of the pad substrate to the handle assembly 105. A pad substrate retention fixture 1303 can be seen where the pad substrate is mechanically fastened to the pad substrate strut 1301 and related handle assembly 105. In some embodiments of the present invention, the pad substrate strut 1301 is curved to conform to a pad substrate.

Figure 14:
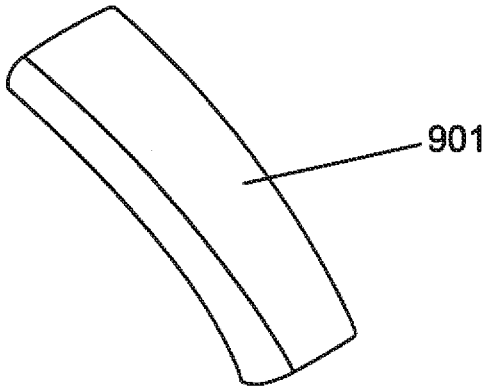
FIG. 14 depicts a handle overlay of the dispensing pad cleaner.

FIG. 14 depicts a handle overlay 901 of the dispensing pad cleaner. As previously stated, the handle overlay is made from a soft durometer material to provide a comfortable and secure grip for the user.

Figure 15:
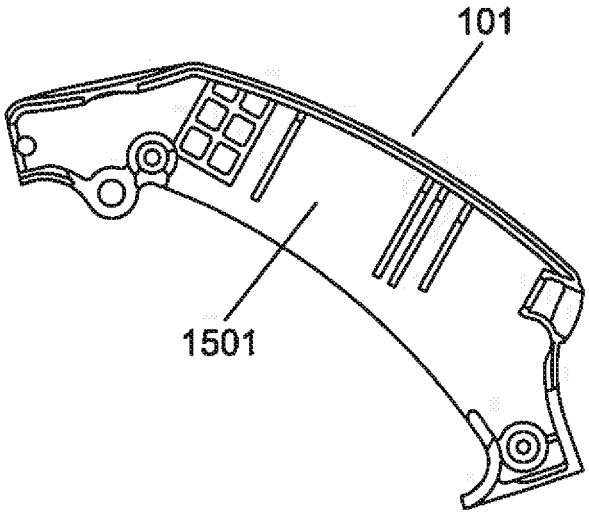
FIG. 15 depicts a handle half of the dispensing pad cleaner.
Figure 16:
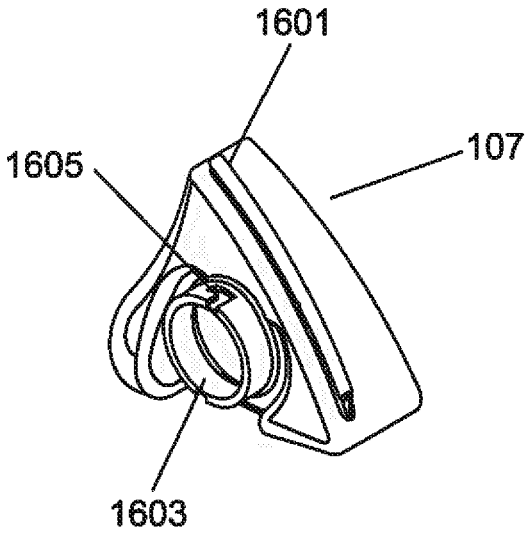
FIG. 16 depicts a reservoir of the dispensing pad cleaner.

FIG. 15 depicts a handle half 1501 of the dispensing pad cleaner. This handle half 1501 mates with the handle assembly 105 to form a handle that also incorporates the pump within the two pieces. Fastening features and pump retention features can be clearly seen in FIG. 15. As the two halves are joined together, the reservoir 107, as further depicted in FIG. 16, is retained by mechanical means such as a reservoir attachment protrusion 1601 that provides a protrusion, in one embodiment a linear protrusion, that can be captured and retained by the handle half 1501 and handle assembly 105 when formed or attached together. A reservoir fill opening 1603 can also be seen protruding from the reservoir 107 with at least one reservoir engagement feature 1605 that may include a slot, recess, or slot with an angled (such as right angled) opening in the reservoir fill opening 1603 to allow for engagement and retention of the reservoir cap 109 (not shown in FIG. 16).

Figure 17:
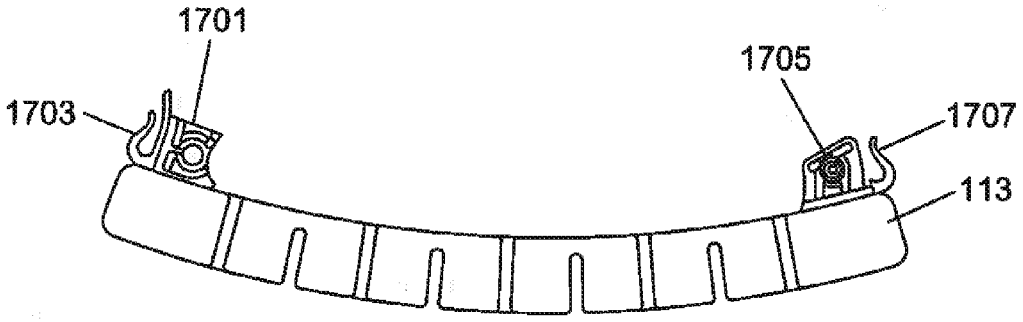
FIG. 17 is a side view of a pad substrate assembly of the dispensing pad cleaner.

FIG. 17 is a side view of a pad substrate assembly 113 of the dispensing pad cleaner. A front substrate strut attachment feature 1701 can be seen along with a rear substrate strut attachment feature 1705. The attachment features may be protrusions or recesses with mating geometries to allow attachment of the pad substrate 113 to the handle assembly 105. In addition, a first pad hook 1703 can be seen as well as a second pad hook 1707. The pad hooks engage with pad retention slots (see FIGS. 1 and 8) to secure the pad to the pad substrate. The pad hooks may be curved and flare outward to provide secure retention of the pad to the pad substrate while allowing for ease of removal and replacement.

Figure 18:
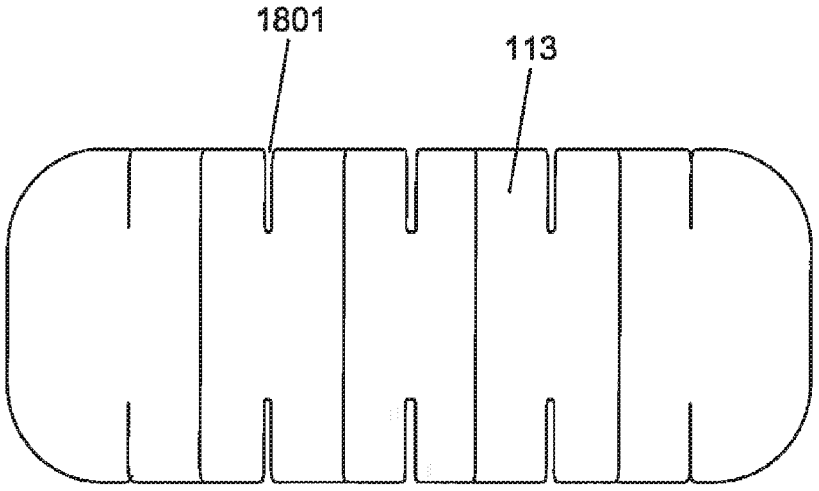
FIG. 18 is a plan view of the pad substrate assembly of the dispensing pad cleaner.
Figure 19:
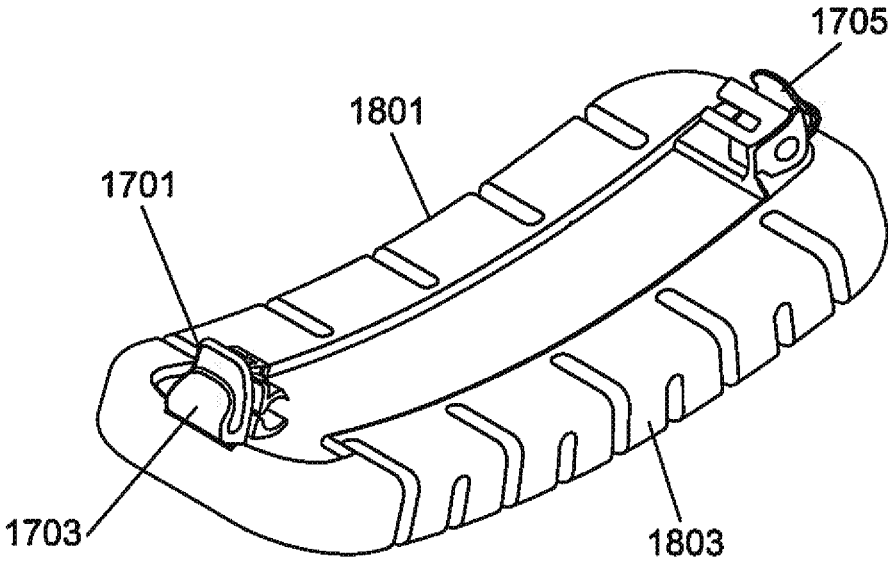
FIG. 19 is a perspective view of the pad substrate assembly of the dispensing pad cleaner.

FIG. 18 is a plan view of the pad substrate assembly 113 of the dispensing pad cleaner showing side cuts 1801 that alternate with full transverse cuts. In some embodiments of the present invention, the substrate is curved or otherwise retained in a curved position. The perspective view of FIG. 19 better shows the curved substrate embodiment and also further depicts the attachment features 1701 and 1705 as well as the first pad hook 1703 and the second pad hook 1705. While the substrate may be curved, downward pressure by the user may straighten out the substrate, providing improved cleaning force.

Figure 20:
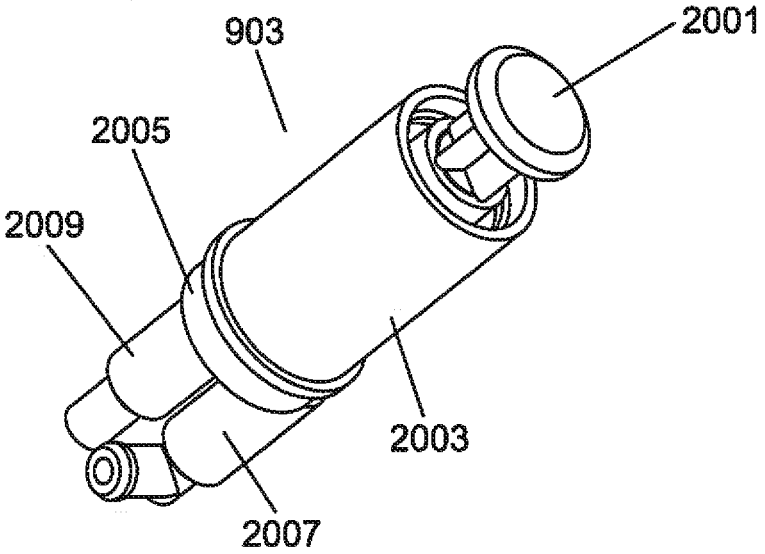
FIG. 20 is a perspective view of the pump of the dispensing pad cleaner.
Figure 21:
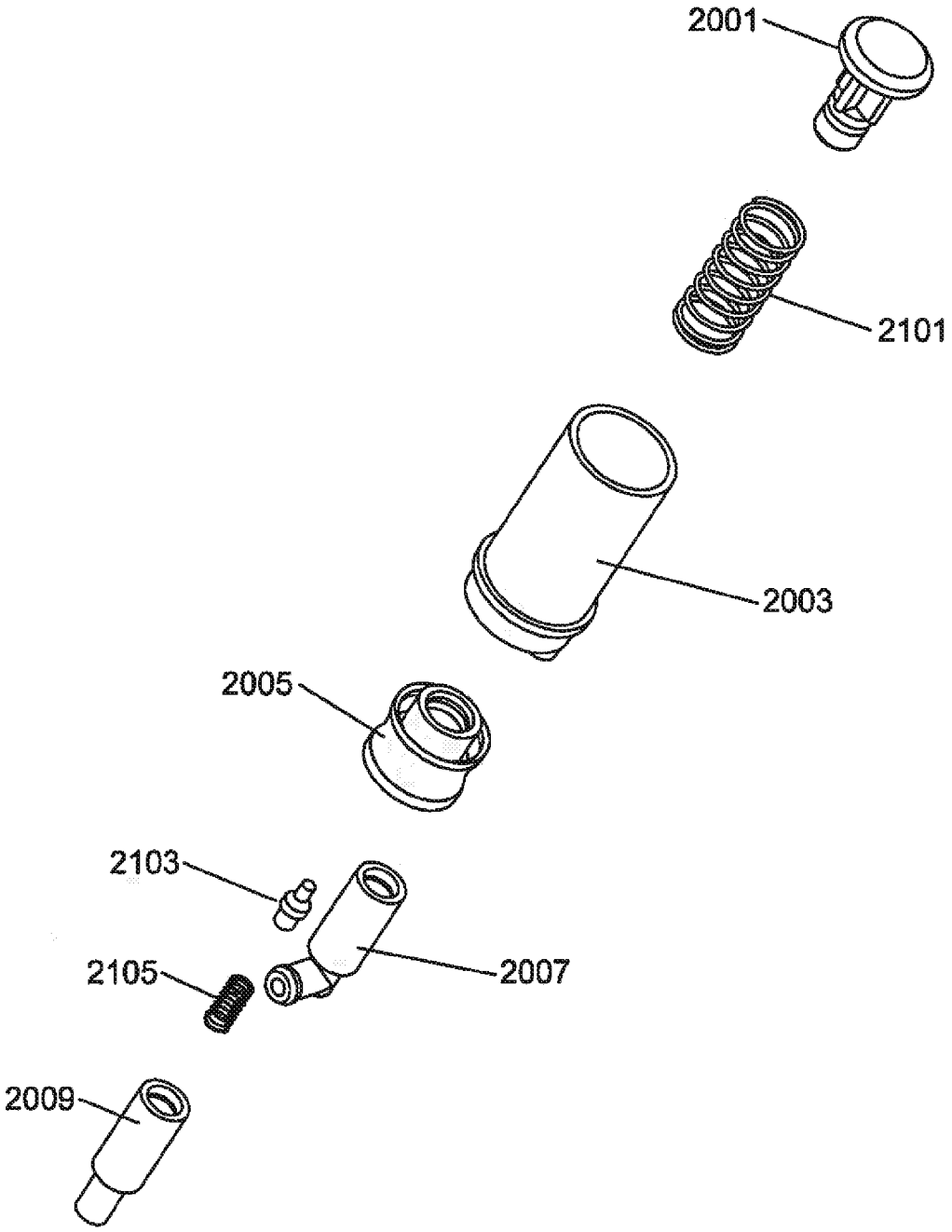
FIG. 21 is an exploded view of the pump of FIG. 20.

FIG. 20 is a perspective view of the pump 903 of the dispensing pad cleaner. Various embodiments of the present invention may employ various types of pumps. In this example, a linear piston style pump is depicted. A pump piston stem 2001 can be seen that provides a surface for the pump engagement cam to move when the pump actuator lever is moved. The pump piston stem 2001 is in turn connected to the pump piston (not show in FIG. 20, see FIG. 21). A pump cylinder 2003 houses and seals the pump piston and a pump body 2005 provides fluid communication between the pump cylinder 2003 and the pump intake 2007 and the pump discharge 2009. For both the pump intake 2007 and the pump discharge 2009 fittings can be seen to allow attachment to a hose, conduit, or the like. To show the inner workings of the exemplary pump 903, an exploded view of the pump can be seen in FIG. 21. A spring 2101 can be seen to return the piston 2103 to a given linear position in the cylinder. The piston 2103 also has seals to provide a liquid tight seal between the piston and the cylinder, thus allowing for movement and spray of the cleaning solution placed within the reservoir of the dispensing pad cleaner. A piston spring 2105 can also be seen to provide return force to the piston 2103 as it travels through the cylinder 2003. Seals such as O-rings and gaskets are used as necessary to provide for a liquid tight seal and associated pressurization and expulsion of cleaning solution by the pump 903.

To use the dispensing pad cleaner, cleaning solution or a similar liquid is placed in the reservoir and the reservoir then appropriately capped. A pump actuator lever is squeezed and released repeatedly, driving the liquid from the reservoir and through a dispensing nozzle. The dispensing pad cleaner is positioned such that the expelled liquid is deposited on a surface to be cleaned, and the dispensing pad cleaner is used to scrub and subsequently clean the surface. The dispensing pad cleaner provides a novel arrangement for dispensing cleaning solution or similar liquid in an efficient and cost effective manner, something heretofore not possible with separate dispensing bottles and cleaning devices.

It is, therefore, apparent that there has been provided, in accordance with the various objects of the present invention, a dispensing pad cleaner. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and the attached drawings.

What is claimed is:

1. A dispensing pad cleaner comprising:

a handle assembly and a handle half that mates with the handle assembly;

a front support beam connecting the handle assembly to a pad substrate;

the pad substrate comprising a flexible material;

a wedge shaped reservoir for liquid retention having a reservoir cap and attached to the underside of the front support beam;

a pump for dispensing liquid retained in the reservoir;

the pump for dispensing liquid being embedded within and surrounded by the mated handle assembly and handle half;

a fluid channel from the reservoir to the pump;

a dispensing nozzle with a fluid channel to the pump;

the pump being actuated by user interaction with a lever located within an opening made by the conjoining of the handle assembly, front support beam and pad substrate;

wherein the lever is mechanically linked to the pump through a curved cam structure such that movement of the lever translates to linear actuation of the pump and subsequent dispensing of the liquid through the dispensing nozzle.

2. The dispensing pad cleaner of claim 1, wherein the reservoir cap is located on a vertical wall of the reservoir.

3. The dispensing pad cleaner of claim 1, wherein the reservoir cap further comprises a taper valve for admission of make up air into the reservoir while preventing liquid in the reservoir from leaking out.

4. The dispensing pad cleaner of claim 1, wherein the dispensing nozzle protrudes through the handle assembly.

5. The dispensing pad cleaner of claim 1, wherein the pump is a linear piston and cylinder pump.

6. The dispensing pad cleaner of claim 1, wherein the handle assembly further comprises a thumb rest.

7. The dispensing pad cleaner of claim 1, wherein the pump is located within the handle assembly.

8. The dispensing pad cleaner of claim 1, wherein the pump further includes a spring to provide return of the interacting lever while the lever is operated by a user.

9. The dispensing pad cleaner of claim 1, wherein the pad substrate is curved.

10. The dispensing pad cleaner of claim 1, wherein the pad substrate comprises side cuts.

11. The dispensing pad cleaner of claim 1, further comprising a handle overlay located along a gripping section of the handle assembly.

12. The dispensing pad cleaner of claim 1, further comprising a cleaning pad.

13. The dispensing pad cleaner of claim 12 wherein the dispensing pad cleaner further comprises a first pad hook and a second pad hook and the cleaning pad further comprises a first pad retention slot and a second pad retention slot.

14. The dispensing pad cleaner of claim 12, wherein the cleaning pad further comprises a woven abrasive material.

15. A cleaning pad for the dispensing pad cleaner of claim 1, the cleaning pad comprising:

a woven abrasive material;

a first pad retention tab having a first pad retention slot through the first pad retention tab;

and a second pad retention tab having a second pad retention slot through the second pad retention tab.

16. A dispensing pad cleaner comprising:

a handle assembly and a handle half that mates with the handle assembly;

a front support beam connecting the handle assembly to a pad substrate;

the pad substrate comprising a flexible material;

a wedge shaped reservoir for liquid retention attached to the underside of the front support beam;

a pump for dispensing liquid in fluid communication with the reservoir;

the pump for dispensing liquid being embedded within and surrounded by the mated handle assembly and handle half;

a dispensing nozzle in fluid communication with the pump;

a lever located within an opening made by the conjoining of the handle assembly, front support beam and pad substrate; the lever being mechanically coupled to the pump through a curved cam structure such that movement of the lever translates to linear actuation of the pump and subsequent dispensing of the liquid through the dispensing nozzle.

17. The dispensing pad cleaner of claim 16, further comprising a cleaning pad.

18. The dispensing pad cleaner of claim 17 wherein the dispensing pad cleaner further comprises a first pad hook and a second pad hook and the cleaning pad further comprises a first pad retention slot and a second pad retention slot.

* * * * *